United States Patent [19]

Toyono et al.

[11] 4,265,197

[45] May 5, 1981

[54] DEVELOPING METHOD AND APPARATUS USING APPLICATION OF FIRST AND SECOND ALTERNATING BIAS VOLTAGES FOR LATENT IMAGE END PORTIONS AND TONE GRADATION, RESPECTIVELY

[75] Inventors: Tsutomu Toyono, Tokyo; Shunji Nakamura, Kawasaki; Junichiro Kanbe, Tokyo; Yasuyuki Tamura, Kawasaki; Tohru Takahashi, Tokyo, all of Japan

[73] Assignee: Canon Kabushiki Kaisha, Tokyo, Japan

[21] Appl. No.: 124,910

[22] Filed: Feb. 26, 1980

[30] Foreign Application Priority Data

Mar. 6, 1979 [JP] Japan ..... 54-25921

[51] Int. Cl.[3] ..... G03G 15/09

[52] U.S. Cl. ..... 118/657; 118/661; 430/122; 430/103; 430/125; 355/300; 355/3 CH

[58] Field of Search ..... 430/122, 103; 355/3 DD, 355/3 CH; 118/657, 661

[56] References Cited

U.S. PATENT DOCUMENTS 4,174,903 11/1979 Snelling ..... 118/6 57

*Primary Examiner*—John D. Welsh

*Attorney, Agent, or Firm*—Fitzpatrick, Cella, Harper & Scinto

[57] ABSTRACT

A developing method and apparatus in which a developer supporting member is opposed to a latent image bearing member with a clearance therebetween and developer is caused to be transferred from the developer supporting member to the latent image bearing member to effect development and wherein a first and a second developing portion are provided as the developer supporting member, these effect development in the named order to complete the developing step, a first alternating bias for causing the developer to be transferred so as to mainly develop the image end portion of the latent image is imparted to the first developing portion, and a second alternating bias for causing the developer to be transferred so as to mainly effect the development for reproducing the tone of the latent image is imparted to the second developing portion.

10 Claims, 6 Drawing Figures

DEVELOPING METHOD AND APPARATUS USING APPLICATION OF FIRST AND SECOND ALTERNATING BIAS VOLTAGES FOR LATENT IMAGE END PORTIONS AND TONE GRADATION, RESPECTIVELY

BACKGROUND OF THE INVENTION

1. Field of the Invention

This invention relates to a developing method for developing a latent image by the use of a developer and an apparatus therefor, and more particularly to a developing method which enables obtainment of fogless visible images excellent in sharpness and tone reproduction, and an apparatus therefor.

2. Description of the Prior Art

Various types of developing methods using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the powder cloud method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog.

To avoid such fog or background toner deposition, there has been proposed the transfer development with space between toner donor and image bearing member in which a toner layer and an electrostatic image bearing surface are disposed in opposed relationship with a clearance therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100$\mu$) and actually, accidents such as pressure contact of the developer and mixed foreign substances are liable to occur between the two surfaces. Also, maintaining such a fine clearance often involves difficulties in designing of the apparatus.

A second problem is that images obtained by the above-described toner transfer development usually lack half-tone reproducibility. In the toner transfer development, the toner does not fly until the toner overcomes the binding power to the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, and therefore, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for the line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 discloses a method in which dry, one component magnetic toner on the non-magnetic, non-conductive transfer cylinder which encloses a rotating cylindrical magnet is transferred to the deposit zone to develop an electrostatic latent image on coated paper, but this patent does not suggest that a bias is applied for the above-described purpose.

SUMMARY OF THE INVENTION

It is an object of the present invention to provide a developing method in which a latent image is developed by subjecting a developer to the action of an electric field and applying an alternating voltage to the developing clearance with a view to improve the tone reproduction in transfer development, and an apparatus therefor.

It is a further object of the present invention to provide a developing method in which a developer supporting member is opposed to a latent image bearing member with a clearance therebetween and developer is caused to be transferred from the developer supporting member to the latent image bearing member to effect development and wherein a first and a second developing portion are provided as the developer supporting member, these effect development in the named order to complete the developing step, a first alternating bias for causing the developer to be transferred so as to mainly develop the image end portion of the latent image is imparted to the first developing portion, and a second alternating bias for causing the developer to be transferred so as to mainly effect the development for reproducing the tone of the latent image is imparted to the second developing portion, and an apparatus therefor.

It is still a further object of the present invention to provide a developing method in which an alternating bias having a frequency of 800 Hz or higher is imparted as the first alternating bias, and an apparatus therefor.

It is yet still a further object of the present invention to provide a developing method in which, as the first alternating bias, an alternating bias is imparted which satisfies $$V_{min} < V_L - |Vth \cdot f|$$

where $V_L$ is the potential of the non-image area, $V_{min}$ is the minimum value of the alternating bias and $|Vth \cdot f|$ is the minimum threshold potential between the latent image surface to which developer can be separated from the developer supporting member and the developer supporting member, and an apparatus therefor.

It is a further object of the present invention to provide a developing method in which an alternating bias having a frequency of 1 KHz or less is imparted as the second alternating bias, and an apparatus therefor.

It is a further object of the present invention to provide a developing method in which the first and second developing portions are non-magnetic rotatable members each enclosing magnetic poles therein, and an apparatus therefor.

It is a further object of the present invention to provide a developing method in which the first developing portion is provided by a first rotation of a non-magnetic rotatable member enclosing magnetic poles therein and the second developing portion is provided by a second rotation of said non-magnetic rotatable member, and an apparatus therefor.

It is a further object of the present invention to provide a developing method in which a magnetic toner layer is formed on a rotatable non-magnetic sleeve enclosing a magnet therein and the sleeve is opposed to a latent image formation member having a back electrode with a clearance therebetween to effect development and wherein a first alternating electric field is applied to the non-magnetic sleeve to visualize the latent image formation member, whereafter a second alternating electric field is applied to said non-magnetic sleeve or a second developing sleeve based on said construction to again visualize said visualized latent image formation surface, and an apparatus therefor.

It is a further object of the present invention to provide a developing method in which the frequency of the first alternating electric field is 1 KHz or less and the frequency of the second alternating electric field is 800 Hz or higher, and an apparatus therefor.

Thus, the present invention has the following effects:

(1) By the first developing portion, the reciprocating movement of the developer between the developer supporting member and the latent image bearing member can be increased or the amount of developer transfer toward the latent image bearing member can be increased, so that a kind of cloud state can be formed and the development of the end portion of the image can be accomplished by an edge effect phenomenon and there can be obtained a visualized image in which the line image is sharp.

(2) By the second developing portion, the developer can be caused to accomplish faithful reproduction in accordance with the level or the density of the latent image to thereby improve the tone reproducibility.

(3) The developer back transfer stage takes place without fail due to the alternating bias and therefore, the fog in the non-image area can be minimized to such a degree that it offers substantially no problem.

(4) The developing process is effected in such a manner that the edge development is first carried out sufficiently by the first developing portion and then good reproduction of half-tone or the like is accomplished by the second developing portion and therefore, even the density variation of an original of any pattern, a light image, a spot image or the like can be faithfully reproduced, so that there is finally obtained a good visualized image which is free of fog and high in tone reproducibility.

Other objects and features of the present invention will become apparent from the following detailed description of some embodiments of the invention taken in conjunction with the accompanying drawings.

DESCRIPTION OF THE PREFERRED EMBODIMENTS

Figure 1A:
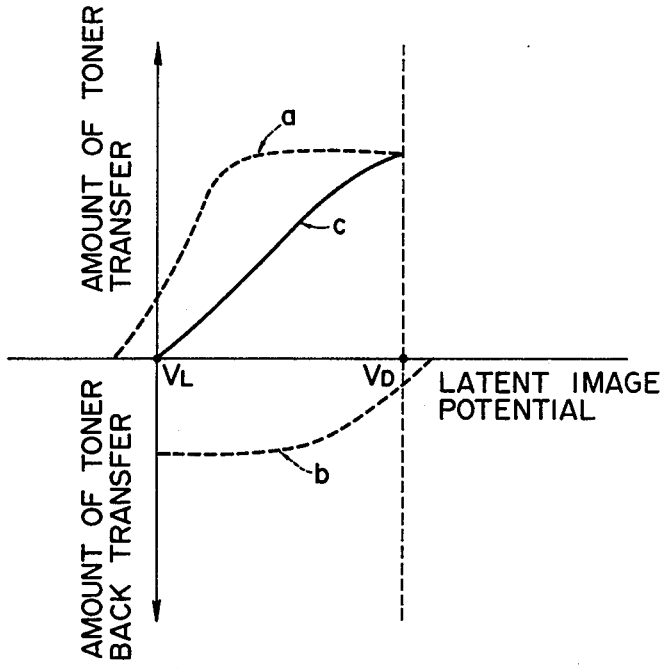
FIG. 1A illustrates the amount of transition of the toner and the characteristic of the degree of toner back transition for the potential of a latent image.
Figure 1B:
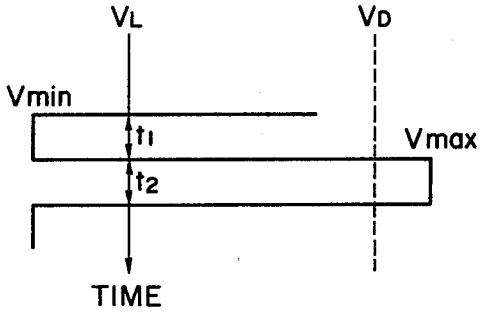
FIG. 1B illustrates an example of the voltage waveform applied.

Reference is first had to FIGS. 1A and 1B to describe the principle of the improved tone reproducibility expressed as the object and effect of the present invention.

FIG. 1A is a graph in which the abscissa represents the latent image potential and the ordinate represents the amount of toner transfer (positive direction) from a developer carrying member (hereinafter referred to as the toner carrying member) to an electrostatic image bearing surface or the amount of toner back transfer (negative direction; the amount of transfer will later be described) with which the toner deposited on the electrostatic image bearing surface is stripped off to the toner carrying member. As the latent image potential, a non-image area potential $V_L$ (this is usually the surface potential of a region corresponding to the light portion of the image and is of the minimum value as a potential) and an image area potential $V_D$ (this is usually the surface potential of a region corresponding to the dark portion of the image and is of the maximum value as a potential) are represented as the potentials of the opposite ends. The surface potential of the half-tone region of the image including a half-tone assumes a potential intermediate of $V_D$ and $V_L$ depending on the degree of the tone thereof.

In FIG. 1B, an example of the alternate voltage form applied to the toner carrying member is depicted with potential as the abscissa and time as the ordinate. There is exemplarily shown a rectangular wave, whereas the waveform is not restricted to such waveform. The shown rectangular wave is a periodical alternating waveform in which a bias voltage of the minimum value $V_{min}$ of the voltage applied to the toner carrying member with the back electrode of the electrostatic image bearing member as the standard is applied at a time interval $t_1$ and a bias voltage of the maximum value $V_{max}$ of said applied voltage is applied at a time interval $t_2$.

The image area potential $V_D$ assumes a positive potential or a negative potential depending on the electrostatic image formation process used, and this also holds true with the non-image area potential $V_L$. However, herein, to facilitate the understanding, description will be made by taking as an example the case where $V_D$ is a positive potential. Of course, this is only for illustration and the present invention is not restricted thereto. When $V_D > O$, the relation of $V_D$ to the non-image area potential $V_L$ becomes $V_D > V_L$, of course. Now, when the relation between the maximum voltage $V_{max}$ and the minimum potential $V_{min}$ applied to the toner carrying member and $V_L$ is set so as to satisfy $$V_{max} > V_D > V_L > V_{min} \quad (1),$$

the bias voltage $V_{min}$ acts to cause toner particles to be transferred from the toner carrying member to the electrostatic image bearing member at the time interval $t_1$ and thus, this stage is called the toner transfer stage. At the time interval $t_2$, the bias voltage $V_{max}$ acts to cause the toner transferred to the electrostatic image bearing member at the time interval $t_1$ to be returned to the toner carrying member and thus, this stage is called the toner back transfer stage.

In FIG. 1A, the amount of toner transfer and the amount of toner back transfer are plotted with respect to the latent image potential in a model-like manner. The term "amount of toner back transfer" is herein used to suppose a condition in which, unlike the actual state, toner is deposited as a uniform layer on both of the image area and the non-image area of the electrostatic image bearing member at $t_2$ and to indicate the amount of toner back-transferred toward the toner carrying member when the bias voltage $V_{max}$ has been applied from said condition, and the term "amount of back transfer" is adopted with the intention of representing the probability of toner back transfer.

Now, the amount of toner transfer from the toner carrying member to the electrostatic image bearing member at the toner transfer stage is as indicated by a broken-line curve a in FIG. 1A. The gradient of this curve is substantially equal to the gradient of a curve in a case where the alternate bias voltage is not applied. This gradient is great and moreover, the amount of toner transfer tends to be saturated at a value intermediate of $V_L$ and $V_D$, and accordingly, such curve is inferior in reproduction of half-tone images and poor in tone reproducibility. A second broken-line curve b indicated in FIG. 1A represents the probability of said toner back transfer at the toner back transfer stage.

When setting the aforementioned alternating voltage, it is necessary to reduce the amount of toner deposited on the non-image area and increase the amount of toner deposited on the image area to thereby make the image density by toner sufficient, and it is desirable to set this voltage value to $$V_{min} \div V_L - |Vth{\cdot}f| \quad (2)$$

where $|Vth{\cdot}f|$ is the minimum threshold potential between the electrostatic image formation surface to which toner can be separated from the toner carrying member surface and said toner carrying member. This value is variable by the type of the developer, the conditions of development, etc. By so setting, the deposition of toner which will cause fog of the non-image area may be suppressed. Also, a sufficient image density may be provided by setting the voltage to $$V_{max} \div V_D + |Vth{\cdot}\gamma| \quad (3)$$

where $|Vth{\cdot}\gamma|$ is the minimum threshold potential between the electrostatic image formation surface from which toner can be separated and back-transferred to the toner carrying member and the toner carrying member surface.

The toner transfer stage and the toner back transfer stage take place repetitively as described above, whereby there can finally be obtained a visible image which is small in gradient as indicated by a curve c in FIG. 1A and very excellent in tone reproducibility and in which the deposition of toner on the non-image area is of such a degree as will offer no practical problem.

However, if development is effected only by a single developing portion, the development of the end portions of the image sometimes becomes insufficient and particularly, there is a problem that the line image becomes thin.

Figure 2:
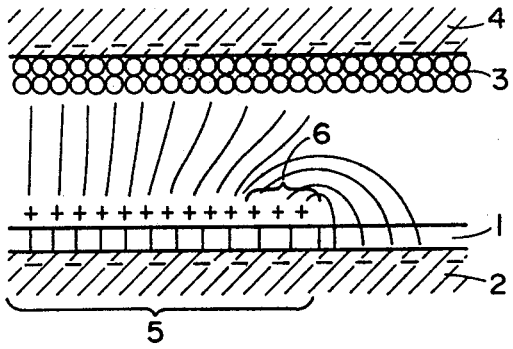
FIG. 2 illustrates the electric line of force of the latent image bearing member and the developer supporting member.

The developing method of this type is such that developer is caused to be transferred in accordance with the electric line of force from the electrostatic image and it is understood that the electric field of the end portion of the image is such as shown in FIG. 2. That is, a part 6 of the electric field of the image end portion goes toward the back electrode 2 of the electrostatic image bearing member 1, and the electric field attracting the toner 3, namely, the electric field which goes toward the conductor portion of the toner supporting surface 4, emanates from a portion slightly inward of the end portion of the image area. Therefore, the area to which the toner is attracted and adheres is inward of the image end portion and such end portion remains undeveloped. Such phenomenon can be improved by selecting $V_{min}$ of said periodical alternating bias to $V_L >> V_{min}$ and increasing the amount of toner transfer so that the electric line of force of the image end portion sufficiently goes toward the toner supporting member. However, occurrence of fog in the non-image area is unavoidable and therefore, to eliminate the fog in this state, $V_{max} >> V_L$ is selected and the amount of back transfer is increased, whereby the occurrence of fog can be prevented. On the other hand, it has been found that there is an undesirable possibility that the amount of back transfer in the image area is also increased to prevent a practical image density from being provided.

Therefore, according to the present invention, a first developing portion for applying to the toner supporting member an alternating bias which enables the image end portion to be sufficiently developed is provided, and then a second developing portion is provided, and an alternating bias which enables a sufficient image density to be obtained and which is excellent in tone reproducibility and creates no fog in the non-image area is applied thereto, so that by the coupling of the two developing portions, there is obtained a fogless visualized image whose end portion has been sufficiently developed and which is very excellent in tone reproducibility.

It has been found that as the method of applying the alternating bias on the first developing portion, use may be made of a first method using a high frequency wave and a second method of setting the minimum value $V_{min}$ of the applied voltage to $V_{min} >> V_L$, or in other words, setting the minimum value $V_{min}$ so as to satisfy $$V_{min} < V_L - |V_{th \cdot f}| \quad (4)$$

and increasing the amount of transfer. These two methods will hereinafter be described in detail.

First, in the first method, by increasing the cycle of the alternating bias during development, the reciprocating movement of toner in the clearance between the toner supporting member and the latent image bearing surface is made active and the toner in said developing clearance is rendered into a cloud-like state. It is considered that, by doing so, the toner suspended in said clearance at the end portion of the latent image can be caused to adhere to the end portion of the image due to the marginal effect.

The second method, as already described in connection with FIG. 2, comprises setting the minimum applied voltage $V_{min}$ of the alternating bias in the first developing portion so that the electric line of force of the image end portion sufficiently goes to the toner supporting member.

In this manner, the image end portion is mainly developed in the first developing portion while, on the other hand, the visualized image after having passed through the first developing portion cannot be satisfactory in respect to fog of the non-image area and tone reproducibility. Therefore, in the second developing portion, development for correcting these drawbacks is effected. In this second developing portion, it is accomplished by applying the alternating bias described in connection with FIG. 1. Where the second development is effected, there is obtained a final visible image following the second developing bias, but the image end portion follows the first developing portion. This is because, as described in connection with FIG. 2, the second developing portion is not originally directed to the development of the image end portion and the image end portion developed in the first developing portion is reinforced by the marginal electric field and it is therefore considered that such image end portion is hardly affected by the second development.

Figure 3:
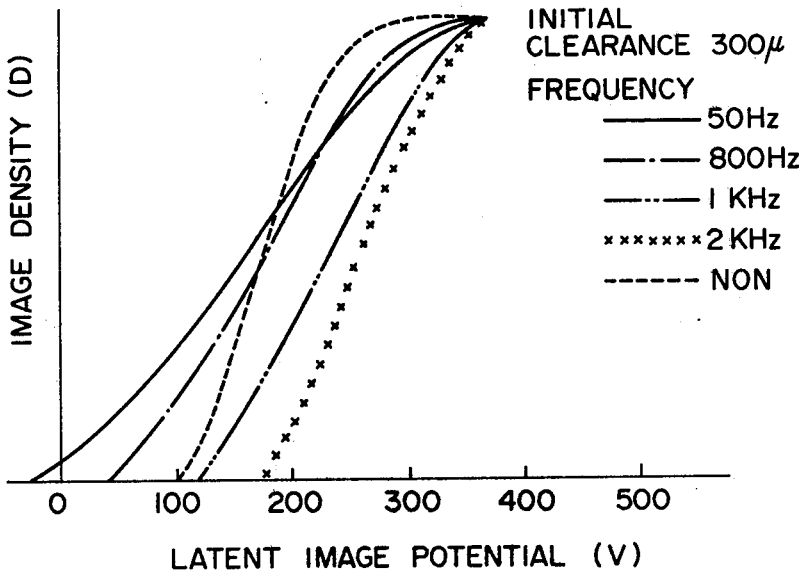
FIG. 3 is a graph illustrating the relation between the latent image potential and the image density with the frequency of the alternating electric field varied.

What is important in this second development is that the frequency of the applied alternate electric field has its upper limit. That is, as exemplarily shown in FIG. 3, if the frequency is increased, the $\gamma$ value will gradually become greater and the effect of enhancing the tone reproducibility will become reduced and, if the frequency exceeds 1 KHz, said effect becomes almost null. The reason for this may be considered as follows. In the developing process during which the alternate electric field has been applied, when toner repeats transfer and back transfer between the surface of the toner carrying member and the electrostatic image formation surface, a limited response time is necessary to ensure the reciprocating movement of the toner. Particularly, the toner which is caused to effect transfer by a weak electric field requires a long time to positively effect the transfer. On the other hand, in order to reproduce half-tone density, it is necessary that the toner subjected to an electric field which is weak but exceeds a certain threshold value be positively transferred within one half period of the alternate electric field. For that purpose, a lower frequency of the alternate electric field is more advantageous and a particularly good tone reproducibility is obtained in the area of low frequency.

However, in contradistinction with this, in the case of the first developing method in the first developing portion, when the toner repeats transfer and back transfer between the surface of the toner carrying member and the electrostatic image formation surface, quick reciprocation of the toner rather than the posive reciprocating movement of the toner becomes necessary for the formation of the cloud-like state of the toner between the surface of the toner carrying member and the electrostatic image formation surface, and conversely to the frequency in the second developing portion, a frequency of 800 Hz or higher is desirable.

Embodiments of the device according to the present invention will hereinafter be described.

Embodiment 1

Figure 4:
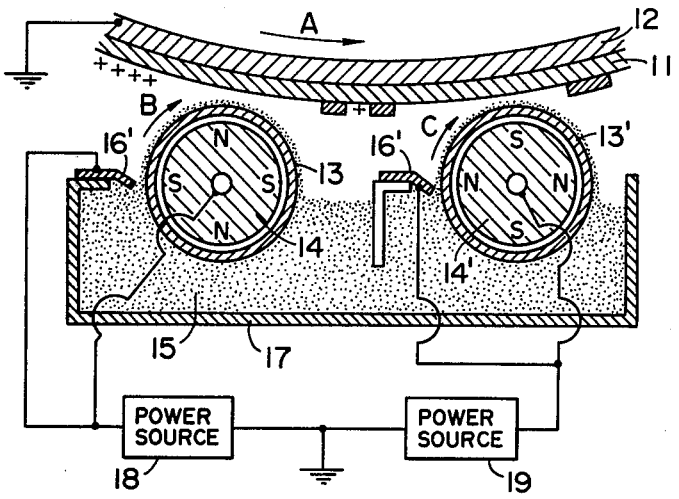
FIGS. 4 and 5 are cross-sectional views showing embodiments of the developing method and apparatus according to the present invention.

In FIG. 4, reference numeral 11 designates a zinc oxide photosensitive medium and reference numeral 12 denotes a back electrode. In an unshown portion, an electrostatic latent image is formed on the photosensitive medium, which is moved in the direction of arrow A. Designated by 13 is a sleeve of non-magnetic stainless metal having a diameter of 40 mm and having a permanent magnet 14 fixed therewithin. The sleeve 13 is rotated in the direction of arrow B and the peripheral velocity thereof is about 200 mm/sec. which is equal to the peripheral velocity of the photosensitive medium. Denoted by 15 is insulative magnetic toner which consists of 50% by weight of styrene resin, 38% by weight of magnetite and 2% by weight of charge control agent. The toner is conveyed by rotation of the sleeve 13 and the application thickness thereof on the sleeve is controlled to about 70μ by a magnetic blade 16 disposed in proximity to the sleeve 13 and in opposed relationship with one of the magnetic poles of the magnet 14. Charge is imparted to the toner by the friction charging between the toner and the sleeve 13 so that the toner becomes suitable for the development of the latent image. Designated by 17 is a toner container. The clearance between the sleeve 13 and the photosensitive medium 11 is maintained at the closest distance of 150μ. The blade 16 and the sleeve 13 are maintained in electrically conductive state and a first alternate voltage is applied thereto by a conventional power source 18. The electrostatic latent image had a dark area potential of −450 V and a light area potential of −40 V. The first alternate voltage comprises an alternating current 1400 $V_{pp}$ having a frequency of about 1200 Hz and a direct current −300 V superposed thereon. The second developing portion is substantially identical in construction to the first developing portion and comprises a sleeve 13', a magnet 14' and a magnetic blade 16', and the peripheral velocity of the sleeve 13' is equal to that of the sleeve 13. The sleeve 13' is moved in the direction of arrow C. The toner on the sleeve 13' is controlled to a layer thickness of about 100μ by the blade 16', and the clearance between the sleeve 13' and the photosensitive medium 11 is maintained at about 200μ. It is for the purpose of providing a sufficient density of the developed image that the toner layer in the second developing portion is greater in thickness than the toner layer in the first developing portion. The blade 16' and the sleeve 13' are also electrically conductive and an alternate voltage is applied thereto by a power source 19. This alternate voltage comprises an alternating current 900 $V_{pp}$ having a frequency of about 350 Hz and a direct current −200 V superposed thereon. In the above-described construction, it has been possible to obtain a clear image which is good in thin-line image and high in tone reproducibility.

Embodiment 2

Figure 5:
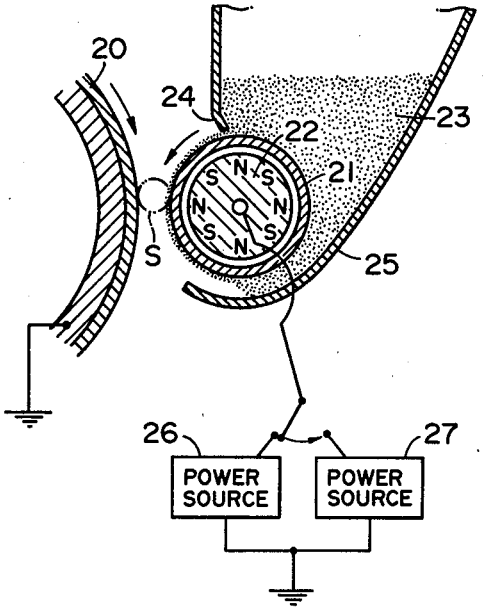

In FIG. 5, reference numeral 20 designates a photosensitive drum having a CdS layer and an insulating layer and having a diameter of 40 mm, and reference numeral 21 denotes a sleeve of non-magnetic stainless metal enclosing a permanent magnet 22 therein and having a diameter of 15 mm. The photosensitive drum 20 and the sleeve 21 are rotated at an equal peripheral velocity of about 100 mm/sec. in the same direction. Denoted by 23 is insulative magnetic toner which consists of 65% by weight of polyethylene resin and 35% by weight of magnetite, etc., and has 0.5% by weight of colloidal silica extraneously added thereto to improve the fluidity of the toner. The toner is conveyed by the sleeve 21 and uniformly controlled by a toner thickness controlling member 24 of iron disposed in proximity to the surface of the sleeve 21 with a clearance of about 150μ therebetween.

Denoted by 25 is a toner container. The minimum clearance between the sleeve 21 and the photosensitive drum 20 is maintained at about 200μ by suitable positioning means S.

On the photosensitive drum 20, an electrostatic latent image having a dark area potential +500 V and a light area potential zero V is formed by latent image formation means, not shown. A first alternate voltage is applied by a power source 26. The first alternate voltage comprises an alternating current 1000 $V_{pp}$ having a frequency of about 200 Hz and a direct current +150 V superposed thereon. Development has been effected by applying this voltage at first. The visualized image on the photosensitive drum in this case is good in respect to the development of the image end portion, but the non-image area thereof also tends to have a great deal of toner deposited thereon. Next, the photosensitive drum makes one full rotation without being subjected to the steps of latent image formation, image transfer, cleaning, etc., whereafter the developing alternate bias has been changed over to a second power source 27 to effect the second development. This alternate voltage has comprised an alternating current 750 $V_{pp}$ having a frequency of 220 Hz and a direct current +250 V superposed thereon. As the result, the fog created in the non-image area during the first development has been substantially completely removed and there has been obtained a good image which is high in tone reproducibility and sharp even at the image end portion.

Of course, the present invention is not restricted to the above-described embodiments.

We claim:

1. A developing method in which a developer supporting member is opposed to a latent image bearing member with a clearance therebetween so that developer is caused to be transferred from said supporting member to said latent image bearing member to effect development, the improvement residing in that a first and a second developing portion are provided as said developer supporting member so that these portions effect development in the named order so as to complete the developing step, a first alternating bias for causing the developer to be transferred so as to develop mainly the edge portions of the latent image is imparted to said first developing portion and a second alternating bias for causing the developer to be transferred so as to to reproduce mainly the tone gradation of the latent image is imparted to said second developing portion.

2. The developing method according to claim 1, wherein said first alternating bias is an alternating bias of frequency 800 Hz or higher.

3. The developing method according to claim 1, wherein said first alternating bias is an alternating bias which satisfies $$V_{min} < V_L - |V_{th \cdot f}|$$

where $V_L$ is the potential of the non-image area of the latent image, $V_{min}$ is the minimum value of the alternating bias, and $|V_{th \cdot f}|$ is the minimum absolute potential difference between the latent image surface to which the developer is separable from said supporting member and said developer supporting member.

4. The developing method according to claim 1, wherein said second alternating bias is an alternating bias of frequency 1 KHz or lower.

5. The developing method according to claim 1, wherein said first and second developing portions are non-magnetic rotatable members enclosing therein magnetic poles, respectively.

6. The developing method according to claim 1, wherein said first developing portion is provided by a first rotation of a non-magnetic rotatable member enclosing therein magnetic poles, and said second developing portion is provided by a second rotation of said non-magnetic rotatable member.

7. A developing method in which a magnetic toner layer is formed on a rotatable non-magnetic sleeve enclosing a magnet therein and said sleeve is opposed to a latent image formation member having a back electrode with a clearance maintained therebetween to thereby effect development, the improvement residing in that a first alternating electric field is applied to said non-magnetic sleeve to visualize said latent image formation member, whereafter a second alternating electric field is applied to said non-magnetic sleeve or a second developing sleeve based on said construction to again visualize said visualized latent image formation surface.

8. The developing method according to claim 7, wherein the frequency of said first alternating electric field is 800 Hz or higher and the frequency of said second alternating electric field is 1 KHz or lower.

9. A developing apparatus in which a developer supporting member is disposed with a clearance with respect to a latent image bearing member and development is effected with developer being caused to be transferred from said developer supporting member to said latent image bearing member, the improvement comprising first and second developing means provided in opposed relationship with said latent image bearing member in the named order, bias means for imparting a first alternating bias to said first developing means, and bias means for imparting to said second developing means a second alternating bias which more contributes to improved tone gradation than said first alternating bias.

10. A developing apparatus in which a developer supporting member is disposed with a clearance with respect to a latent image bearing member and development is effected with developer being caused to be transferred from said developer supporting member to said latent image bearing member, the improvement residing in that said developer supporting member comprises a non-magnetic rotatable member enclosing magnetic poles therein and that said apparatus has means for imparting a first developing alternating bias during a first rotation of said rotatable member, means for imparting a second developing alternating bias during a second rotation of said rotatable member, and means for changing over the alternating bias from said first alternating bias to said second alternating bias after termination of the first rotation of said non-magnetic rotatable member, whereby a developing bias is provided by said first and second alternating biases.

* * * * *

UNITED STATES PATENT AND TRADEMARK OFFICE

CERTIFICATE OF CORRECTION

PATENT NO. : 4,265,197
DATED : May 5, 1981
INVENTOR(S) : TSUTOMU TOYONO, ET AL.

It is certified that error appears in the above—identified patent and that said Letters Patent is hereby corrected as shown below:

Column 6

Lines 48 and 60, change "÷"to read --$\bar{\div}$--.

Column 8

Line 60, change "the posive" to read --a slow--.

Column 9

Line 15, change "50%" to read --60%--.

Column 10

Line 54, delete "to".

Signed and Sealed this

Twentieth Day of October 1981

[SEAL]

Attest:

GERALD J. MOSSINGHOFF

Attesting Officer

Commissioner of Patents and Trademarks